US005632064A

United States Patent [19]

Lautenschläger

[11] Patent Number: 5,632,064

[45] Date of Patent: May 27, 1997

[54] CABINET HINGE

[76] Inventor: Reinhard Lautenschläger, Am Mühlberg 20, D-64354 Reinheim, Germany

[21] Appl. No.: 588,147

[22] Filed: Jan. 18, 1996

[30] Foreign Application Priority Data

Feb. 1, 1995 [DE] Germany ..... 195 03 476.7
Feb. 27, 1995 [DE] Germany ..... 195 06 714.2

[51] Int. Cl.[6] ..... E05D 7/12

[52] U.S. Cl. ..... 16/272; 16/382

[58] Field of Search ..... 16/272, 254, 382, 16/383, 384, 257–261, 270, 271, DIG. 43

[56] References Cited

U.S. PATENT DOCUMENTS

| | | | |
|---|---|---|---|
| 1,483,624 | 3/1924 | Walker | 16/374 |
| 5,025,530 | 6/1991 | Ferrari et al. | 16/382 |
| 5,159,740 | 11/1992 | Brustle et al. | 16/382 |
| 5,206,974 | 5/1993 | Lautenschlager | 16/272 |
| 5,388,309 | 2/1995 | Grass | 16/272 |

FOREIGN PATENT DOCUMENTS

| | | |
|---|---|---|
| 0077045 | 8/1913 | Austria . |
| 0303885 | 2/1989 | European Pat. Off. . |
| 3239041 | 1/1993 | Germany . |
| 3913319 | 4/1993 | Germany . |
| 4018235 | 4/1993 | Germany . |
| 4236879 | 5/1994 | Germany . |
| 0379326 | 11/1959 | Switzerland . |

*Primary Examiner*—Chuck Y. Mah

[57] ABSTRACT

Hinge for hanging a door on a cabinet carcase. The door-related hinge member has a cup which can be inserted into a mortise which is created in the back of the door near its adjacent edge and cuts through that edge. A joint-bearing component can be easily and quickly snapped into and removed from the door-related hinge member. A linkage mechanism enabling the door to rotate relative to the cabinet carcase is disposed between the joint-bearing component and the door-related hinge member affixed to the wall of the carcase.

30 Claims, 6 Drawing Sheets

FIG. 14
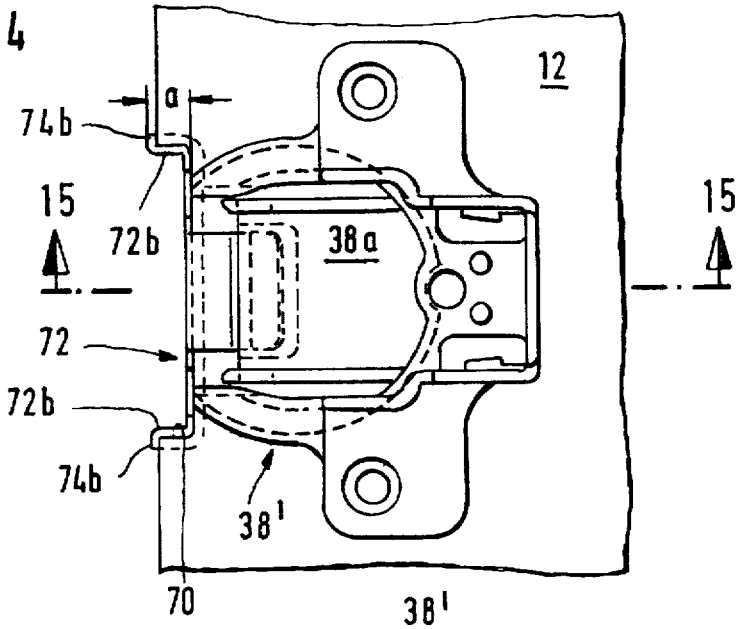
FIG. 15
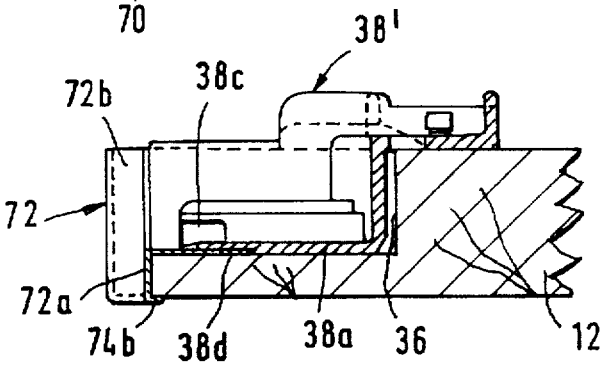
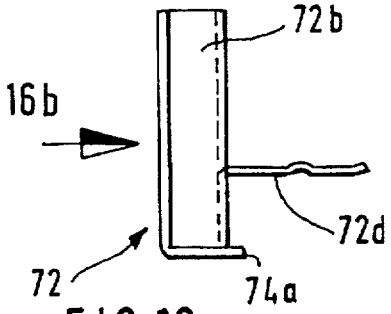
FIG. 16a
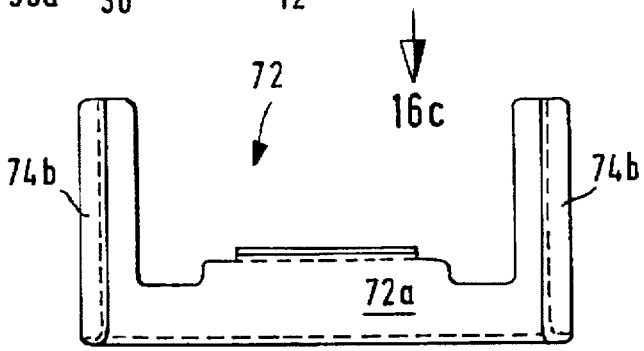
FIG. 16b
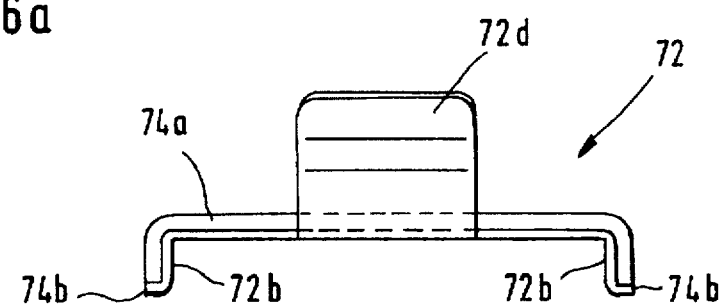
FIG. 16c

CABINET HINGE

The invention relates to a hinge for hanging a door on a cabinet carcase. The door-related member of the hinge bears a cup which can be inserted into a mortise created in the back of a marginal area of the door which breaks through to the adjacent edge of the door, and in which a joint-bearing component insertable from the edge is fastened. A joint mechanism is connected to the joint-bearing component on the door side, the joint-bearing component inserted into the cup being fastened in the mortise at selectable depths of insertion on the one hand by one of two projections protruding each from the opposite lateral defining surface of the joint-bearing component and a groove ruling in the direction of insertion and fittedly accepting the respective projection, and on the other hand by a section secured against withdrawal by a catch means releasable by operating a handle accessible from the outside. The carcase-related hinge member is in the form of an elongated supporting arm that can be fastened on the associated carcase supposing wall to the door-related end of the joint mechanism. The catch means has, as a locking element, a spring made from spring metal with two lock sections connected to the joint-bearing mechanism. Each lock section of the spring is connected with a spring section provided laterally beside the joint-bearing component and brought out of the cup as a handle for the displacement of the lock section from the position reaching behind an associated locking edge. The lock sections can be brought by contrary displacement toward one another out of locking engagement with the associated lock edge in the cup.

BACKGROUND OF THE INVENTION

A cabinet hinge of this kind, configured as a single-joint hinge, is known (DE-OS 42 36 879), which permits a door to be removed and then reinstalled on the cabinet carcase by the fact that the catch device between the joint-bearing component and the cup is released. The joint-bearing component is swung out of the cup or—for the purpose of assembly—the joint-bearing component is swung into the cup in the door and locked. An embodiment is disclosed therein, in which a locking means disposed on a separate locking block, displaceable longitudinally relative to the joint bearer, is provided with two locking sections which can be brought out of engagement with the cup by pressing together contrariwise a handle associated with each. The locking element in this case is a component bent from spring wire and held on the locking block, the ends of the spring being brought out so as to form the handles. The known single-joint hinge has been proven to work. However, the catch mechanism with the locking block and the separate wire spring is relatively complex.

The invention is addressed to the problem of improving the known hinge such that the catch means will work better, be more simply constructed and more convenient to operate. Furthermore, the hinge is to be able to be designed not only as a single-joint hinge with pivot axes in front of the cabinet carcase, but also as a multi-joint hinge.

SUMMARY OF THE INVENTION

Setting out from a hinge of the kind described above, this problem is solved by the invention by making the locking element from a leaf of spring metal. Further, the locking sections are formed from two arms of flat spring metal in the space between the lateral defining walls of the joint-bearing component and the confronting defining walls of the recess in the cup accommodating the joint-bearing component in the vicinity of the catch system. The locking sections can be resiliently deformed parallel to the inner side of the door by providing in each of them a window as a locking receiver for an associated catch projection protruding from the defining walls of the recess in the cup, and by providing a handle on the margin of each spring arm brought up out of the gap between the confronting walls of the link-bearing component and the cup recess that accommodates it. Making the locking means from sheet metal permits a stiffer design of the releasing means, while the handles provided can be made broader so that they are convenient to grasp and use.

If the cup has on its side opposite the edge of the door a projection lying on the inside surface of the door, in which the recess to accommodate a corresponding projection of the joint-bearing component is provided, the locking element has a substantially flat fastening section fastened to the underside of the projection of the joint-bearing component confronting the bottom of the recess of the cup section. The resiliently deformable arms can be integral with an arm bearing section cut on the fastening section.

The handles are preferably formed by integral metal sections formed on the upper margin of the resiliently deformable arms and turned outwardly in opposite directions. They can then in turned by curved or roughened in a manner to facilitate grasping between the thumb and index finger.

The fastening of the locking means to the joint-bearing component is expediently accomplished by providing approximately in the middle of the projection of the joint-bearing component, an opening through which a screw can be driven into a tap in the fastening section of the locking element.

To permit the relative longitudinal adjustment of the joint-bearing component in the cup, and thus the horizontal alignment of the door relative to the cabinet carcase, the opening can then be configured as a slot.

To fix the longitudinal adjustment, once made, it is desirable to provide in at least one confronting surface in the fastening section of the locking means parallel serrations running transversely of the slot. The locking means can be drawn tightly together when the screw holding the parts together is tightened.

On the other hand, when the locking means is in the desired position, to prevent it from shifting lengthwise relative to the projection of the joint-bearing component, in an advantageous embodiment of the invention, means which interlock with one another when the joint-bearing component is in the desired locking position are provided on the bottom of the recess in the cup projection. These interlocking means are formed, for example, by at least one projection rising from the bottom of the recess or of the confronting surface of the fastening section and engaging in an associated opening in the fastening section and in the floor of the recess.

The snap fastening between the catch means and the cup is accomplished by the catch projections engaging the windows in the spring arms. In order to achieve additional stabilization of the spring arms against flexure in the catch direction also relative to the joint-bearing component, it may be desirable if on the joint-bearing component, in the area opposite the windows serving as locking receptacle, there is provided a projection engaging in the associated window which reaches underneath the upper edge of the corresponding window. These projections can be formed, for example, by the free ends of a pin piercing the joint-bearing component at right angles to the slot and parallel to the inner side of the door, which afterward is pressed into a bore in the joint-bearing component. Alternatively, a configuration is also possible in which the projections entering the window are integral with the joint-bearing component.

Especially when the hinge of the invention is configured as a single-joint hinge with its axis of rotation lying in front of the cabinet carcase, it may be useful to limit the very great opening angle of 180° and more. This can be achieved in an advantageous embodiment of the invention if the ends of a restraining member limiting the opening angle to the desired degree are connected to the door-related hinge member on the one hand and to the carcase-related hinge member on the other.

The restraining member can then, for example, have two elongated sections of stiff metal wire provided on opposite sides of the longitudinal central plane of the hinge, journaled at one end on or in the door-related hinge member, and guided at the other end for longitudinal displacement on the carcase-related hinge member.

The ends of the metal wires associated with the carcase-related hinge member can be joined together by a crossbar integral with both wires to form an elongated wire loop, which is then made longitudinally displaceable in a slot transversely running all the way through an elongated section of the carcase-related hinge member.

The slot can also be provided in a separately made, elongated guiding component held on the carcase-related hinge member and can be, for example, a plastic injection molded piece or a pressure-cast metal piece. Especially in the case of a relatively short carcase-related hinge member, the guiding component can also be longitudinally displaceable on the carcase-related hinge member, so that when the door is closed it will move into the cabinet interior, but when the door is opened it will shift forward again on the carcase-related hinge member until the open position determining the opening angle is reached.

The ends of the metal wire sections provided on or in the door-related hinge member can, in addition to their pivotal attachment, be mounted also for displacement in the cup, so that in that case there is no need for the guiding component to be displaceable on the carcase-related hinge member.

The restraining means can alternatively also be formed by two substantially U-shaped loops of stiff metal wire which are joined pivotally together at the portions connecting their lateral limbs, while the free ends of the limbs of the one loop are journaled on or in the door-related hinge member and the ends of the limbs of the other loop are journaled on or in the carcase-related hinge member. When the door is closed, the two metal loops will then fold from the outstretched position into the interior of the cabinet.

For the junction between the transverse portions of the two loops of the restraining means, it will be advantageous to provide a tube-like clip bent around the transverse portions.

In all cases the restraining means extending over the gap that forms between the supporting wall and the edge of the door when the door is opened serves the additional advantageous purpose of preventing clothing or the like from entering into this gap and preventing it from being pinched when the door is closed.

The joint mechanism connecting the joint-bearing component to the carcase-related hinge member can not only be configured—in a manner known in itself—as a single-joint mechanism with its axis of rotation situated in front of the front edge of the supporting wall of the carcase and in front of the outer side of the door, but it can also be configured as a multiple-joint mechanism with a virtual axis of rotation shifting in space, in which the carcase-related hinge member is coupled with the joint-bearing component via links connected pivotingly and/or displaceably on them. A hinge configured in this manner is then completely concealed in the closed position.

If a hinge, configured according to the invention as a single-joint hinge, also according to the invention, with its axis situated in front of the front wall of the carcase, is to be used for a recessed door, a gap must normally be provided between the inner side of the supporting wall and the door's front edge facing it, so as to permit the limb bearing the knuckles of the joint to pass through. But such a gap between the door and the carcase is not only unattractive in appearance, but is undesirable also because it permits dust to enter the cabinet interior. Therefore, in a further development of the invention, it may be desirable to mount the cup in the mortise so as to be set back so far from the edge of a corresponding door that the sections of the joint-bearing component and of the carcase-related hinge member that bear the knuckles of the joint-bearing component will lie in a section of the rebate on the edge of the door that continues all the way through its front side to its rear side. The hinge cup is in this case best provided in the area of the breach with integrally attached walls which conceal the breach in the mortise.

Furthermore, it is recommendable for aesthetic reasons to provide at least a portion of the walls covering the junction with short flanges on the edge and the outer side of the door in order to conceal the gap between the hinge cup and the breach in the mortise.

BRIEF DESCRIPTION OF THE DRAWINGS

The invention will be further explained in the following description of several examples in conjunction with the drawing, wherein:

FIG. 14 is a top plan view of the sunken cup of a hinge according to the invention, which is disposed at a greater distance from the associated edge of the door as compared with the sunken cups of the preceding embodiments.

FIG. 15 is a sectional view seen in the direction of the arrows 15—15 in FIG. 14.

FIGS. 16*a*, *b* and *c* are side, front and top views of a masking element used in conjunction with the sunken cup shown in FIGS. 14 and 15.

DETAILED DESCRIPTION

Figure 1:
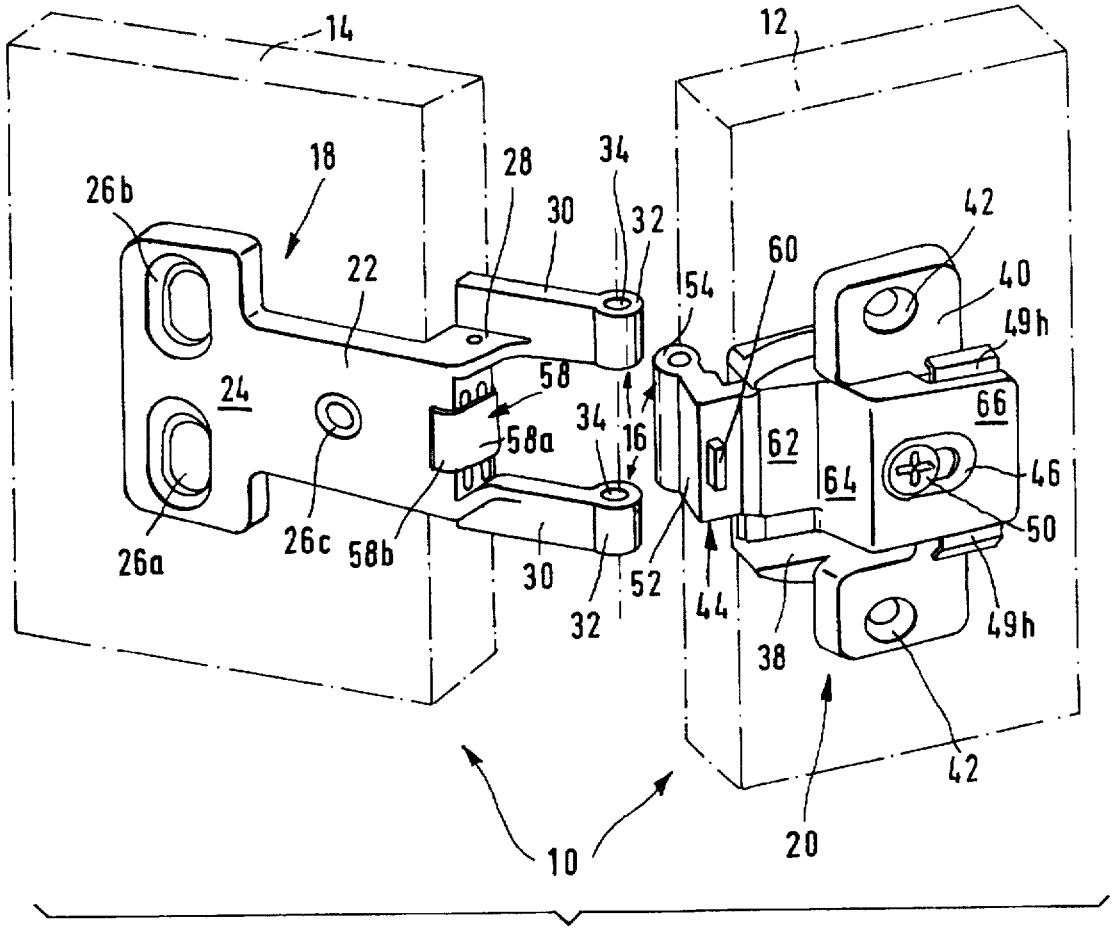
FIG. 1 is a perspective view of a single-joint hinge configured in the manner of the invention, wherein the carcase-related and the door-related members are represented separately and disconnected, and the supporting wall and the door are indicated in broken lines.
Figure 2:
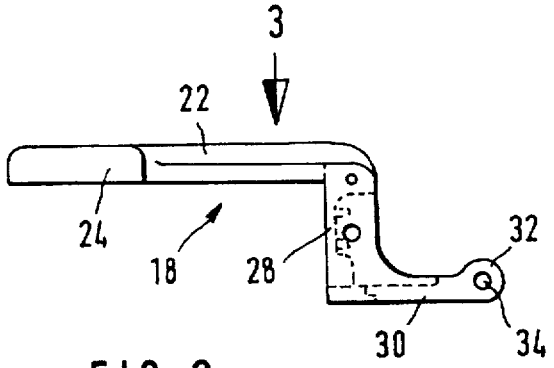
FIG. 2 is a side view of the carcase-related member of the hinge shown in FIG. 1.
Figure 3:
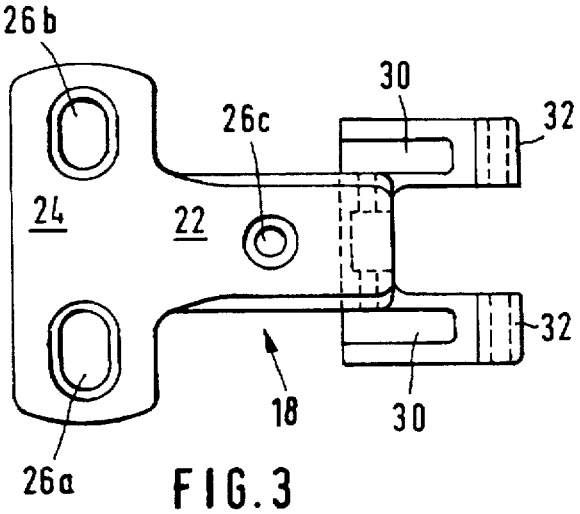
FIG. 3 is a top plan view of the carcase-related member, seen in the direction of the arrow 3 in FIG. 2.

The hinge according to the invention, which is represented in perspective in FIG. 1 and identified as a whole by the numeral 10, is configured as a single-joint hinge and serves to hang an overlay door 12 on the supporting wall 14—the side wall, for example—of a cabinet carcase. The actual hinge joint 16 is placed in front of the front side so that, when the door opens, it will be able if necessary to turn at least 180° against the front of an adjoining second door 12 that might be present. In the present example of the hinge 10, the position of the joint 16 also makes it possible for the door to open by more than an angle of 180° to a point where it faces the outside of the supporting wall if the latter is the outermost side wall of the cabinet. The individual components of the hinge 10 are also represented separately in FIGS. 2 to 11.

First the configuration of the carcase-related hinge member 18 joined by the hinge joint 16 will be described below, as well as the door-related hinge member 20. In FIG. 1, both of these hinge members 18 and 20 are represented separated from one another, i.e., disconnected by removing the pivot pin—not shown here. The carcase-related member 18 is in the form of an elongated supporting arm 22 which at its rear end, i.e., the end pointing into the cabinet interior, is enlarged to form a flange plate 24 which contains three mounting holes 26*a*, 26*b* and 26*c* in a triangular arrangement through which the threaded shafts of mounting screws (not shown) can be driven into the confronting flat side of the supporting wall on which the carcase-related hinge member is to be fastened.

The two mounting holes 26*a* and 26*b* provided in the flange plate 24 are configured as slots running parallel to the joint axis of the hinge, i.e., which when the carcase-related hinge member is first installed permit a certain vertical adjustment of the carcase-related hinge member when the mounting screws are loosened. After the correct vertical position has been set the mounting screws associated with the mounting holes 26*a* and 26*b* are tightened, and in addition the third mounting screw associated with the mounting holes 26*c*, configured as normal countersunk holes, is driven into the carcase wall, thereby fixing the set vertical position of the carcase-related hinge member. A section 28 reaching in front of the front edge of the supporting wall is integral with the door-related front end of the supporting arm 22, and from it two limbs 30 offset vertically from one another project, in whose free ends 32, thickened sleeve-like, the aligned bearing bores 34 are created for the hinge pivot consisting of an elongated hinge pin—not shown in FIG. 1—which pivotally couples the door-related member 20 of the hinge 10 to the supporting-wall related hinge member 18.

The door-related hinge member 20 is largely sunken into a mortise 36 (FIGS. 12, 13 and 20) in the back of the door, this recess, which is essentially circular in plan, is bored or milled into the marginal area of the door back such that it cuts an opening in the edge of the door 12. The part of the door-related hinge part inserted into the mortise 36 is in the form of a cup 38 (FIGS. 7 and 8) that is open to the carcase interior and to the edge of the door, and it can be fastened to the door 12 by a cup mounting flange 40 extending beyond the actual cup diameter and lying on the back of the door 12. In the interior of the cup 38 open at the edge of the door there is a joint-bearing component 44 configured as a slider (FIGS. 4 to 6) and guided for displacement substantially parallel to the flat sides and at right angles to the edge of the door 12, which is held in the cup by a screw 50 driven through a slot-like mounting opening into a tap 48 in a locking means 49 (FIGS. 7 to 11) provided in the cup 38 and 46, in the alignment previously set with the screw loosened.

At its end protruding from the open end of the cup 38, the joint-bearing component 44 has a portion 52 disposed at right angles in front of the outer flat side of the door 12, and its width measured vertically corresponds approximately to the clear distance between the limbs 30 or is slightly smaller in order to create space for a washer which can be provided on bushings provided for containing the pin. At the free end of the bent portion 52 the eye 54 is formed to accommodate the hinge pin. Up to this point, the hinge 10 described is functionally the same as the known single-joint hinges. In the drawing there is also represented a hold-shut mechanism with a spring 58 in the carcase-related hinge member 18 and a cam 60, but since it is also known in itself it is not further described here. The portion of the joint-bearing component 44 inserted into the cup 38 has an arm 62 adjoining at right angles the end of the bent portion 52 remote from the pivot eye, supported in the intended position of use in the cup 38 on its bottom 38*a* and guided between its side walls 38*b*, and it is adjoined by another portion 64 bent substantially at right angles, to which finally a portion 66, again bent at right angles, is added and is provided as a mounting flange, in which the slot 46 is provided, through which the threaded shaft of the screw 50 is driven into the locking means 49.

The portion 66 is guided in a recess between two laterally raised walls 39*a* of a guide portion 39 (FIG. 8) which overreaches the circumference of the portion of the cup 38 lying in the mortise 36 in a direction away from the edge of the associated door 12 and lies upon the inner side of the door. The locking means 49 is made from originally flat spring sheet metal and has a substantially flat fastening section 49*a* into which the tap 49*b* is created for screwing in the shaft of the screw 50. Two additional stamped circular holes 49*c* serve to accommodate the pins 39*c* of circular cross section (FIGS. 7 and 8) projecting from the bottom 39*b* of the portion 39 of the cup 38, which secure the fastening section 49*a* resting on the bottom 39*b* against longitudinal displacement relative to the cup. At their projecting free ends the pins 39*c* are preferably beveled in the manner seen in FIG. 8, to facilitate the engagement of the pins in the holes 49*c* during assembly. Two low, strip-like sections 49*d* are bent up from the two opposite longitudinal margins of the fastening section 49*a*, which are provided on their free margins lying opposite the fastening section with transverse serrations or teeth, which are associated with complementary serrations 66*a* (FIG. 6) in the underside of the portion 66 of the thread bearing component 44. When the serrated boundary edges of the strip-like sections 49*d* are pressed against the serrated strip-like sections 66*a* by tightening the fastening screw 50, the portion 66 is secured against displacement relative to the locking means 49, while when the fastening screw is loosened .such displacement is possible to the degree established by the length of the slot serving as the fastening opening. A strip-like section is likewise turned up from the front transverse margin of the fastening section 49*a*, and resilient arms 49*e* are turned back on its opposite vertical sides and extend each into a space between a guide block 66*b* (FIGS. 4 and 6) projecting from portion 66 to the bottom 39 and the lateral walls 39*a* of the guide portion 39. The spring-elastic arms 49*e* can be elastically flexed into this space parallel to the associated inner side of the door. Within the space the spring arms 49*e* are provided with an end section 49*f* of enlarged area in which a rectangular locking window 49*g* is punched.

A locking projection 39*d* in alignment with the locking windows 49*g* projects from the inner side of the corresponding side wall 39*a* of the guide portion 39, and has on its underside a locking edge cooperating with the bottom edge of the locking window 49*g*, while it is made to slope upward in a ramp-like manner, so that when the portion 66 serving as the mounting flange is inserted between the lateral walls 39*a* of the guide portion 39, the end sections 49*f* of the spring arms 49*e* will be flexed inwardly until the bottom edge of the locking window 49*g* passes over the bottom edge of the locking projections 39*d* and snaps onto its lower locking edge. The mounting flange or projection 66 is then caught between the walls 39*a* of the guide portion 39 and then can it be pulled out upwardly again, i.e., approximately at fight angles to the bottom 39 only if first the spring arms 49*e* of the locking means 49 are flexed against one another to such an extent that the locking windows 49*g* come free of the locking projections 39*d*. To permit this flexing of the spring arms 49*e* for the purpose of unlocking the joint-bearing component 44 from engagement with the cup 39, outwardly turned integral metal sections 49*h* are provided at the upper margins of the end sections 49*f* of the spring arms 49*e*, and serve as handles for unlocking. When these metal sections 49*h* are grasped with the thumb and the index finger of a hand and pressed together, the spring arms are flexed toward one another, thereby releasing the locking windows 49*g* from the associated locking projections 39*d*.

Figure 6:
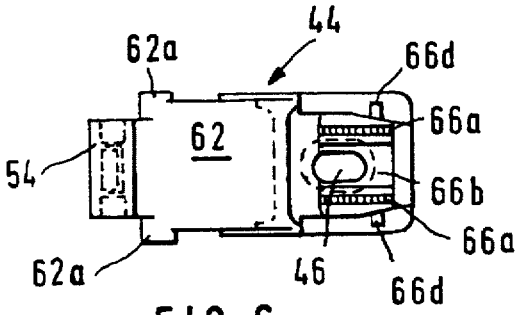
FIG. 6 is a bottom view, seen in the direction of arrow 6 in FIG. 4, of the joint-bearing component.
Figure 7:
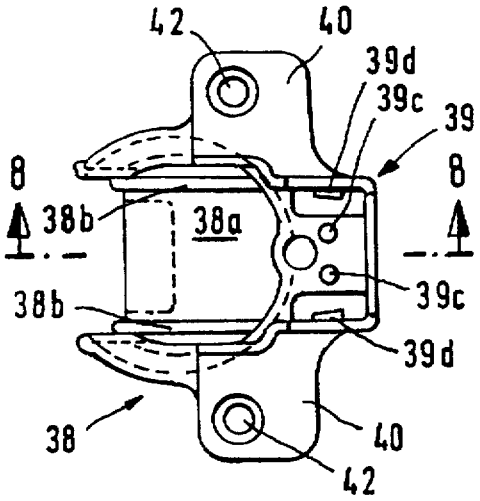
FIG. 7 is a top plan view of the door-related hinge member, configured as a sunken cup, which accommodates the snap-in joint-bearing component according to FIGS. 4 to 6.
Figure 8:
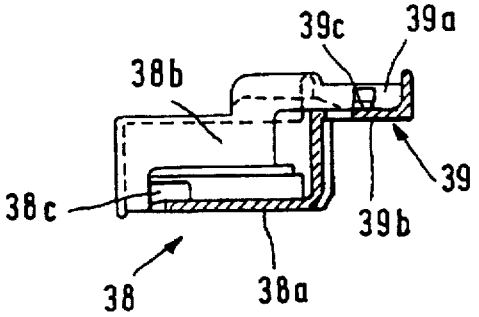
FIG. 8 is a sectional view taken through the cup, seen in the direction of the arrows 8—8.
Figure 9:
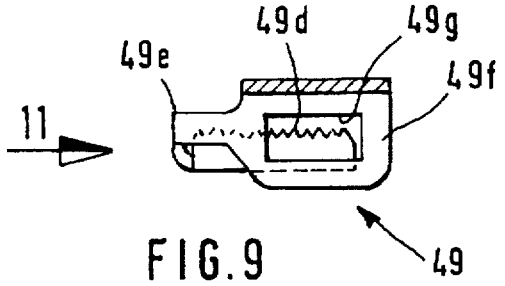
FIG. 9 is a side elevation of the locking element releasably joining the joint-bearing component to the cup.
Figure 10:
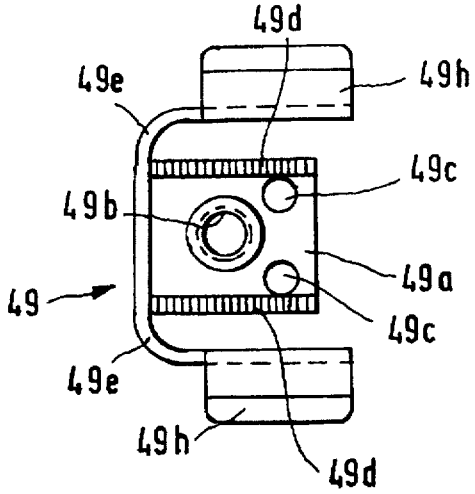
FIG. 10 is a view of the locking element, seen in the direction of arrow 10 in FIG. 9.
Figure 11:
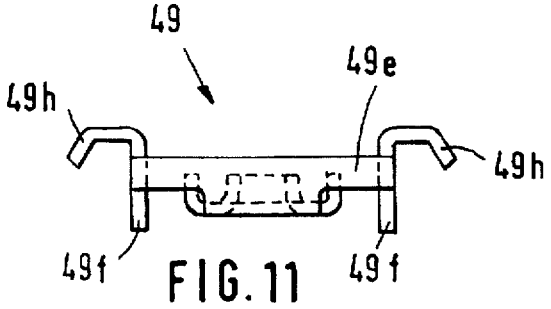
FIG. 11 is a view of the locking element seen in the direction of arrow 11 in FIG. 9.

In order to secure the spring arms 49*e* against flexure at right angles to the unlocking direction, lateral projections reaching under the upper defining edge can be provided on the guide portion 39 of the mounting flange or projection 66. In FIG. 6, such projections 66*d* engaging the locking window of the installed locking means 49 are indicated.

It will be seen from the description thus far of the configuration of the door-related hinge member that the joint-bearing component 44 and its fastening flange or projection 66 is releasably joined, not directly to the cup 38, but via the interposed locking means 49. In order to provide additional securing in the cup when the joint-bearing component is longitudinally adjusted in the cup 38, the arm 62 of the joint-bearing component, that is guided between the lateral walls 38*b* of the cup 38, is provided on its opposite lateral surfaces with projections 62*a* (FIGS. 4 to 6) which can be inserted into forwardly open grooves 38*c* in the lateral walls 38*b* of the cup 38. These projections 62*a* and the grooves 38*c* thus form a guide that additionally secures the joint-bearing component 44 against lifting out of the cup. The length of the grooves 38*c* and the position of the projections 62*a* on the arm 62 is to be chosen such that the guidance is effective over the entire range of adjustment of the joint-bearing component 44 in the cup 38.

Figure 12:
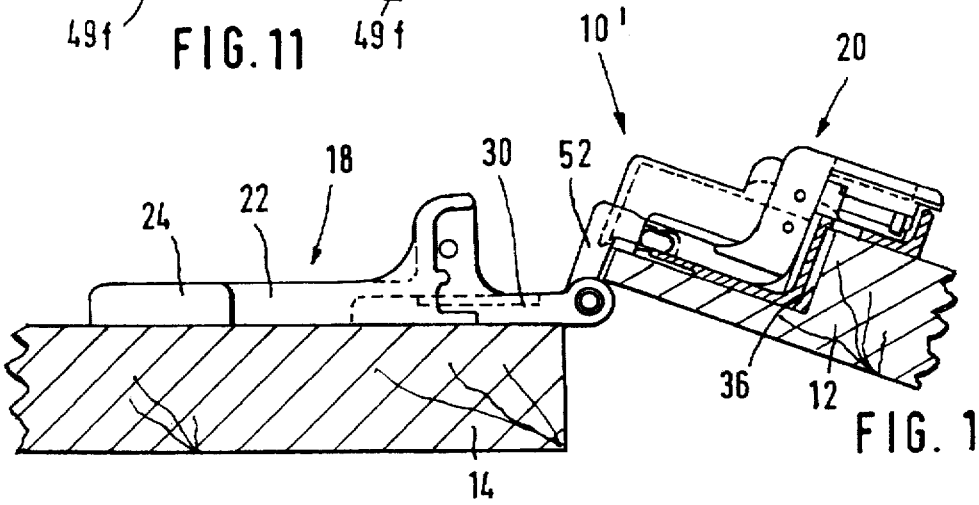
FIG. 12 is a side view of a second embodiment of a hinge according to the invention, partially in section, with the door in an open position, the hinge being configured as a single-joint hinge for a flush handing of a door in a cabinet carcase.
Figure 13:
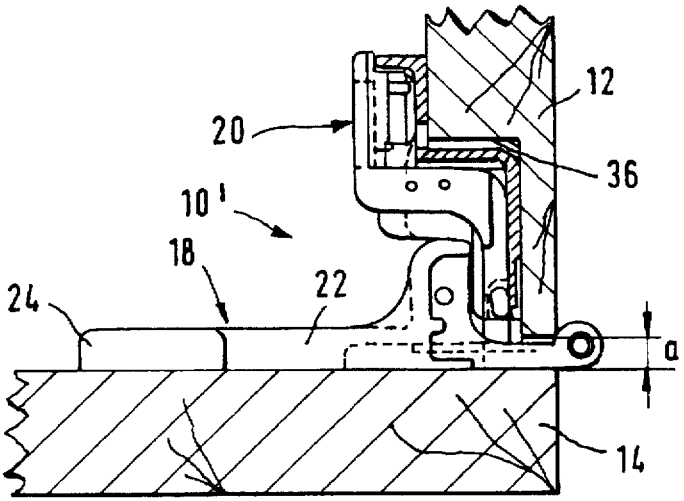
FIG. 13 shows the hinge represented in FIG. 12 with the door in the closed state.

In FIGS. 12 and 13 there is described an embodiment that is a modification of the embodiment described above, of a hinge 10 according to the invention which is also a single-joint hinge 10'. The modifications, however, relate not to the configuration of the cup 38 or of the joint-bearing component and the catch mechanism, but substantially only to the carcase-related hinge member 18. With the hinge 10', the door 12 is to be hung on the supporting wall 14 of a cabinet such that it will not lie against the front edges of the carcase walls in the closed condition, as it does in the case of hinge 10, but will be withdrawn completely within the carcase. That is to say, the hinge 10' serves for hanging a so-called "flush door" on a cabinet carcase. Accordingly, the bent section 28 of the hinge 10 is absent, and the limbs 30 are aligned in prolongation of the supporting arm 22. All-in-all the carcase-related hinge member 18 is set further into the carcase interior by the thickness of the door 12, so that the outer face of the door 12, when closed as shown in FIG. 13, will be approximately flush with the front edge of the supporting wall 14, as well as with the front edges of the bottom and the top of the cabinet. Since the limbs 30 and the double-bent portion 52 must, in the case of hinge 10', pass between the inside surface of the supporting wall of the carcase 14 and the edge of the door 12, a gap is necessarily produced between the inside face of the supporting wall 14 and the edge of the closed door 12, which is indicated in FIG. 13 at $\alpha$. Such a gap, however, not only does not look neat, but it also has the disadvantage that dust can enter and contaminate the interior of the cabinet.

In FIGS. 14 and 15 there is shown a modified hinge cup 38', which can be fastened further back from the edge of the door 12. The edge of the door 12 must be cut back by the amount of the gap a so as to permit the limb 30 and the double-bent portion 52 of the carcase-related hinge member 18 to pass through. The rebate 70 in the edge of the door 12 must then be concealed for appearance purposes. In that case—especially if the hinge cup is made by die casting from metal—it might be considered advisable to provide walls in one piece with the cup 38' to cover the walls in the rebate. This, of course, results in a relatively complex mold for the cup. In the solution represented in FIGS. 14 and 15, therefore, a separately made masking element 72 punched and shaped from sheet metal is provided, which has walls 72*a* and 72*b* which mask the surfaces created in the door and door exterior and laterally in the rebate 70, while at the free margins of the walls 72*b* and at the wall 72*a* associated with the exterior of the door, narrow, turned-in covering flanges 74*b* and 74*a* are formed which cover the gap formed between the walls 72*a* and 72*b* and the recess and rebate 70.

To fasten the masking element 72 shown separately in FIGS. 16*a* to 16*c*, a tongue 72*d* bent at 90° toward the mortise 36 for the cup 38' is provided on the edge of the wall 72*a* facing away from the margin provided with the masking flange 74*a*, and can be inserted into a shallow recess 38*d* open at the end, which is provided on the outside of the bottom 38*a* of the cup 38, and can be held there by spring-elastic catch means not shown. Such catch means can be formed by ridges or projections running transversely of the direction in which the tongue is inserted, and projecting from the confronting surfaces of the tongue 74*d* and the bottom of the recess, which are forced into resilient engagement by the slightly curved tongue.

If the above-described embodiment is, on the other hand, to be configured in the above-indicated manner such that a separate masking element will not be necessary, i.e., the walls covering the walls in the door rebate 70 are to be cast in one piece with the hinge cup 36', the narrow covering flange 74*a* must be eliminated so that the hinge cup can be inserted into mortise 36 and rebate 70 from the inner side of the door.

Figure 17:
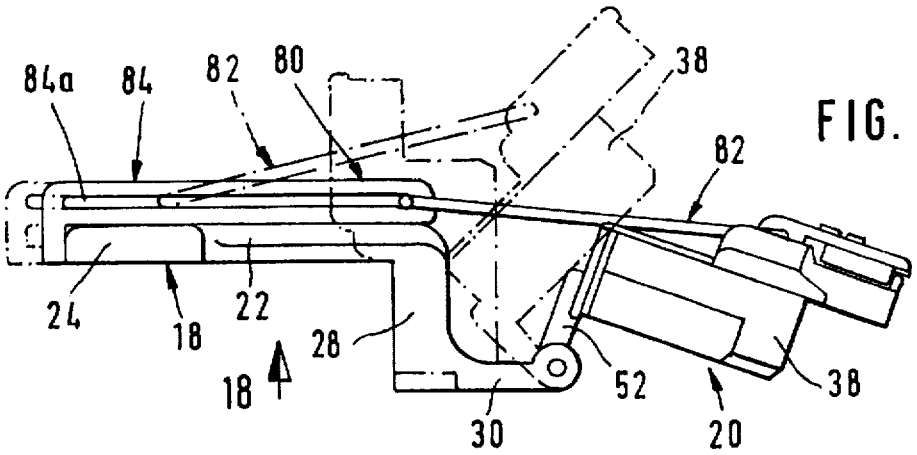
FIG. 17 is a simplified side view of another embodiment of a hinge according to the invention, which, unlike the embodiment shown in FIG. 1, is additionally provided with a restraining member limiting its opening angle and preventing the accidental catching of objects kept in the cabinet.

In FIG. 17 there is shown schematically another embodiment of a single-joint hinge 10 which corresponds in its basic design to the hinge 10, and which is additionally equipped with a restraining device 80 to limit the opening angle of the hinge. This restraining device consists, in the case represented, of two additional components, namely the restrainer represented separately in FIG. 19 in the form of a wire link 82 of stiff metal wire, which has a short transverse section 82*a* from whose ends two elongated metal wire sections 82*b* are bent, which in the case represented terminate each in a short pivot section 82*c* bent each toward the other section 82*b*.

Figure 18:
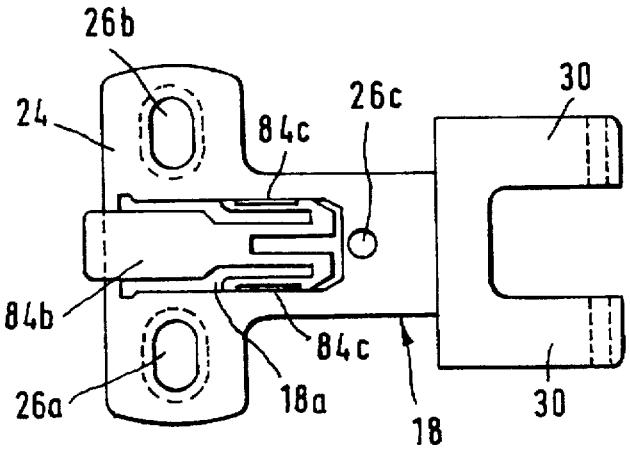
FIG. 18 is a view of the carcase-related member of the foregoing example, seen in the direction of arrow 18 in FIG. 17.

The short transverse section 82*a* of the wire link 82 is guided for longitudinal displacement and articulation in a continuous slot 84*a* parallel to the supporting wall in an elongated guiding component placed upon the supporting arm 18. The guiding component 84, made of plastic in the illustrated case, envelops the back edge of the flange plate 24 and then runs back into an elongated recess 18*a* which is open at the carcase-interior back end and is provided in the underside of the supporting arm 18. In FIG. 18 is shown a bottom view of the carcase-related member 18 of the hinge shown in FIG. 17. It can be seen that the elongated portion 84*b* has at its front end two spring arms 84 whose outwardly pointing upturned ends are in contact with the lateral walls of the elongated recess 18*a*. The mouth of the recess 18*a* on the rearward end of the carcase-related hinge member is narrowed, so that it is easily possible to pull the guiding component 84 out of the carcase-related hinge member until the ends of the spring arms 84*c* come in contact with the narrowed mouth. For complete disassembly [a force] must then be applied [to reduce] the spring arms additionally to the dimension of the width of the rearward mouth of the recess 18*a*. In the assembly on a carcase-related hinge member already fastened on the carcase wall—whether it be after disassembly or for equipping an already installed hinge with an restraining lock—the elongated portion 84*b* is inserted into the rearward mouth of the recess 18*a* and pushed in until the outwardly flexing ends of the spring arms 84*c* come in contact with the carcase-related hinge member. By more intensely pushing inward and simultaneously additional pressing together the spring arms, the portion 84*b* can then be pushed all the way into the recess 18*a*, where it is then displaceable in the given frame, i.e., by the amount which the free ends of the spring arms can slide rearwardly in the recess 18*a* on the side walls thereof, i.e., leftward in FIGS. 17 and 18.

The guiding component 84 described above as a separately made injection molded piece can alternatively also be made of metal, e.g., die-cast zinc. Also, integral production as a unit with the carcase-related hinge member is possible.

Figure 4:
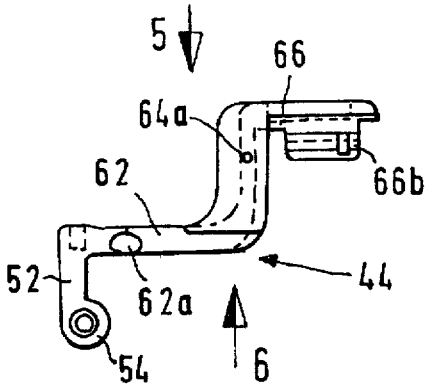
FIG. 4 is a side view of a joint-bearing component forming part of the door-related hinge member of the hinge shown in FIG. 1.
Figure 5:
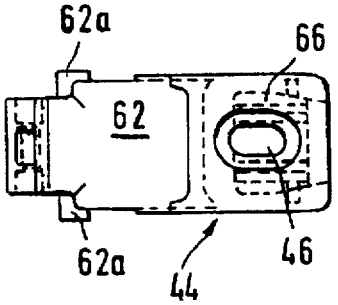
FIG. 5 is a view seen in the direction of arrow 5 in FIG. 4 of the joint-bearing component.

The pivot sections 82*c* of the link 82 are in turn journaled in bores 64*a* (FIG. 4) of the connecting portion 64 of the joint-bearing component 44 (FIG. 4). It can be seen that, when the door is swung out of its maximum open position represented in solid lines in FIG. 17, the wire link 82 will slide rearwardly in the slot 84*a* until it strikes the rearward end of the slot. As closing continues the transverse section 82*a* then pushes the guiding component 84 toward the cabinet interior and the guiding component shifts additionally rearwardly, i.e., toward the interior of a closing cabinet.

It can also be seen that, in the open state, the wire link 82 extends transversely over the opening formed between the supporting wall and the door, and then in the closing action it shifts still further away from the supporting wall, so that the restraining means described additionally functions to prevent articles of clothing or the like that might be contained in the cabinet from being pinched.

Figure 20:
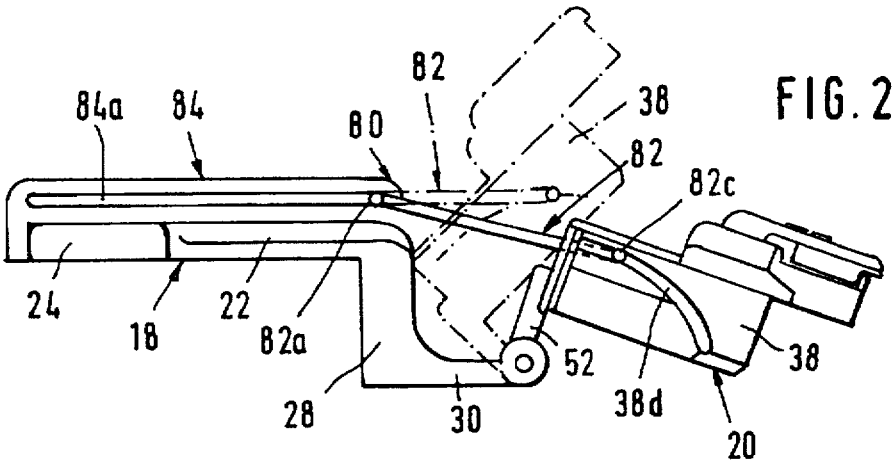
FIG. 20 is a side view of a hinge according to the invention which is another modification of the embodiment in FIG. 17, and is also provided with an opening angle limiter.

The hinge shown in FIG. 20 likewise has a restraining means which again has a wire link 82 serving for restraint, whose transverse portion 82*a* is carried in the slot 84*a* of a guiding component 84. Unlike the embodiment according to FIG. 17 previously described, the guiding component 84 in this case is not displaceable toward the carcase interior, but is fastened fixedly on the supporting arm 22.

For this purpose the pivot sections 82*c* of the wire link 82, which in this case are turned outward, are guided in an elongated, arcuate slot in the lateral walls of the cup. Any escape of the pivot sections 82*c* from their associated arcuate slot is normally prevented by the joint-bearing component 44. If the joint-bearing component, however, is unsnapped and swung out from the cup 38, the pivot sections 82*c* are removed from the corresponding arcuate slot 38*d* by pressing together the metal wire sections 82*b*, that is, the removal of the door from the associated cabinet carcase by unlocking the joint-bearing component 44 from the cup is not prevented by the restraining means 80.

Figure 19:
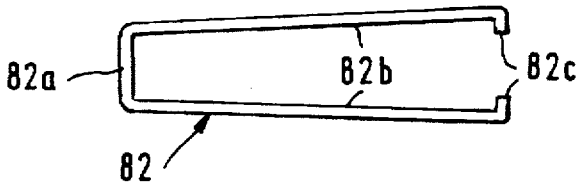
FIG. 19 is a view of the restraining member limiting the opening angle and serving to prevent accidental catching, in the form of a loop made of metal wire.
Figure 21:
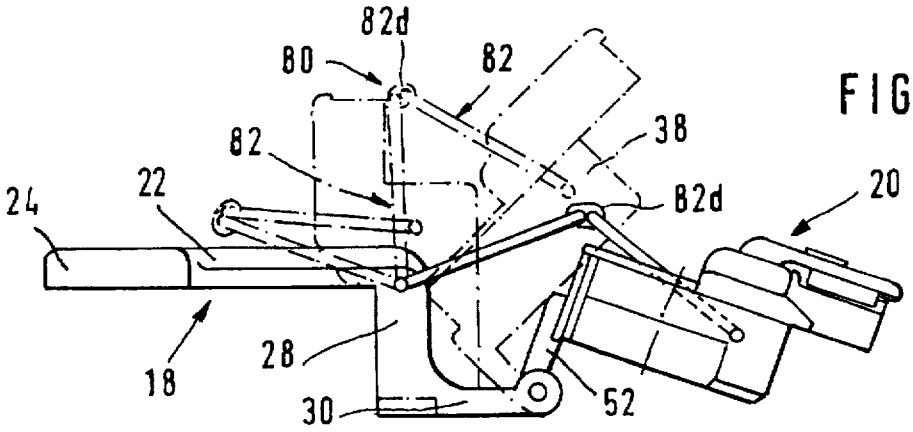
FIG. 21 is a side view of another embodiment in which the restraining member limiting the opening angle is formed by two wire loops which collapse upon closing.

Lastly, FIG. 21 shows an additionally modified embodiment in which the link of the restraining means 80 is formed by two metal wire links 82 which are similar to the metal wire links 82 of FIG. 19, the pivot sections 82*c* of the two wire links 82 being journaled only in bores in the joint-bearing component 44 and in section 28 of the carcase-related hinge member 18. The two legs 82*a* of the links are joined pivotingly together by a tubular clip 82*d* fastened around them. When the hinge of FIG. 21 is closed from the illustrated open position the two wire links 82 thus fold together in the manner indicated in broken lines.

Figure 22:
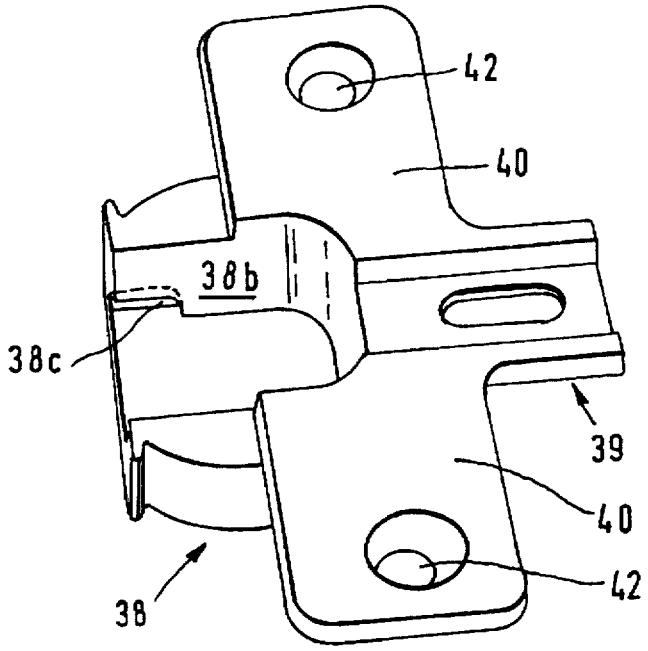
FIG. 22 is a perspective view of the sunken cup of a hinge according to the invention, configured as a multiple-joint hinge.
Figure 23:
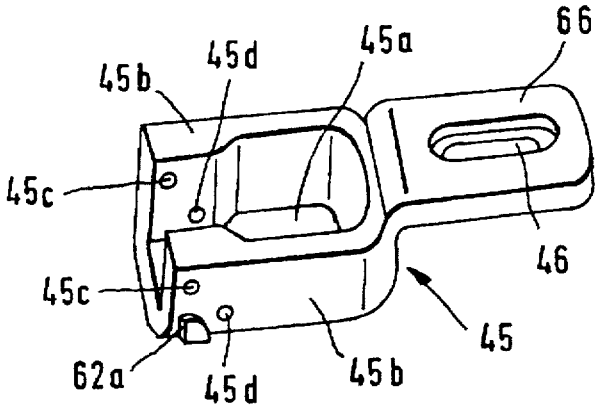
FIG. 23 is a perspective view of the joint-bearing component which can be snap-fastened in the sunken cup shown in FIG. 22.

In FIGS. 22 and 23 there is shown another hinge cup 38 and corresponding joint-bearing component 45 for a multi-joint hinge according to the invention, namely one that is configured in this particular case as a four-joint hinge. The components of the catch mechanism, the actual four-joint mechanism and the carcase-related hinge member are omitted, since the catch mechanism is to be made in accordance with the embodiments described above, while the four-joint mechanism and the carcase-related hinge member might be made like the known four-joint hinges.

It is apparent that the joint-bearing component 45 is configured such that its portion which can be inserted into the interior of the actual cup 38 forms a tub-like recess 45*a* with side walls 45*b*, parallel and spaced apart, in which pivot bores 45*c* and 45*d* are provided for the pivot pins of the hinge links of a four-joint mechanism not shown. The insertion and snapping in place of the joint-bearing component 45 are performed similar to the hinges already described, by the catch mechanism on the one hand and the sliding guide formed by the projections 62*a* which can be inserted from the open end into the grooves provided in the side walls 38*b* of the cup.

What is claimed is:

1. A hinge for hanging a door on a cabinet carcase, comprising;

a carcase-related hinge member (18) in the form of an elongated supporting arm fastenable on an associated carcase supporting wall (14), a door-related hinge member (20) comprising a cup (38,38') with lateral walls insertable into a mortise created in the back of a marginal area of the door, a joint-bearing component insertably connectable into the cup (38,38') and having a joint mechanism for connecting the joint-bearing component with the carcase-related hinge member, wherein the cup with the joint-bearing component inserted therein is fastenable within the mortise at selectable depths determined by a sliding guide formed by two projections (62*a*) protruding from opposite defining lateral surfaces of the joint-bearing component and forwardly open grooves (38*c*) for fittedly accepting the projections in lateral walls of the cup, and by a projecting section (66) of the joint-bearing component securable against withdrawal by catch means which is releasably operable by a handle accessible from outside the door, said catch means having a locking element (49) comprising a spring made from spring metal and having two locking sections connected to the joint-bearing component, and each locking section of the spring being connected with a spring section provided laterally beside the joint-bearing component and brought out of the cup as handles (49*h*) for the displacement of the locking section from a position extending behind an associated locking edge in the cup, and the locking sections being displaceable toward one another out of locking engagement with the associated lock edge in the cup, and wherein the locking sections (49*f*) are formed from two resiliently deformable arms (49*e*) of flat spring metal located in a space between the lateral defining surfaces of the joint-bearing component (44) and confronting defining walls (39*a*) of the cup (38), accomodating the joint-bearing component (44) in the vicinity of the catch means, said locking sections being resiliently deformable parallel to the inner side of the door, a window (49*g*) being provided in each locking section as a locking receiver for an associated catch projection (39*d*) protruding from the defining walls of the cup, and a handle is provided on a margin of each spring arm, brought up out of a gap between confronting walls of a link-bearing component 44 and the cup.

2. The hinge according to claim 1, wherein the cup (38) further comprises a cup projection (39) on a side of the cup opposite the joint mechanism and placeable upon the inside surface of the door, in which a mortise for accommodating the projecting section (66) of the joint-bearing component (44) is provided, and further characterized in that locking element (49) has a substantially flat fastening section (49*a*) which is fastened on the bottom of the projecting section (66) of the joint-bearing component (44) opposite the bottom of the mortise of cup projection (39), and that the resiliently deformable arms (49*e*) are comprised of a single piece of metal having a bent arm bearing section and being joined with the fastening section (49*a*).

3. The hinge according to claim 2, wherein projecting section (66) of the joint-bearing component (44) further comprises a through-opening located substantially central in the projecting section (66) through which a shaft of a locking means fastening screw can be passed and driven into a tap (49*b*) in the fastening section (49*a*) of the locking element (49).

4. The hinge according to claim 3, wherein the through-opening is configured as a slot (46) having a length dimension which permits an adjustment of the position of the fastening section (49*a*) of the locking element (49) on the underside of the projecting section (66) of the joint-bearing component (44) lengthwise of the slot.

5. The hinge according to claim 4, wherein in at least one opposing section of fastening section (49*a*) of locking element (49) is provided with parallel serrations or projections running transversely of the slot (46) and the locking sections can be forced into locking engagement against one another when the locking element's screw (50) is tightened.

6. The hinge according to claim 4, further comprising interlocking means on the bottom (39*b*) of a recess in the cup projection (39) of the cup (38) and on fastening section (49*a*) of locking element (49) for interlocking with one another in a correct catching position of the joint-bearing component (44) in the cup, which prevent relative longitudinal displacement of projecting section (66) of the joint-bearing component (44) in the mortise of the cup (38).

7. The hinge according to claim 6, wherein the interlocking means are formed by a projection (39*c*) protruding from the bottom of the recess of the cup projection (39) or a confronting surface of the fastening section (49*a*) and engaging in an associated complementary opening (49*c*) in the fastening section (49*a*) or in the bottom of the recess.

8. The hinge according to claim 7, further comprising projections (66*a*) on joint-bearing component (44), in an area opposite windows (49*g*) in the spring arms (49*e*) serving as locking receptacles for the projections (66*a*), which engage the associated windows (49*g*).

9. The hinge according to claim 8, wherein the projections (66*a*) hook onto an upper edge of the corresponding windows (49*g*).

10. The hinge according to claim 1, wherein the handles (49*h*) are formed by integral metal sections on an upper margin of the resiliently deformable arms (49*e*) and are bent each outwardly in opposite directions.

11. The hinge according to claim 1, further comprising a pulling member for limiting the opening angle of the hinge, the pulling member having ends which are connected to the door-related hinge member (20) and to the carcase-related hinge member (18).

12. The hinge according to claim 11, wherein the pulling member is formed by two U-shaped loops (82), having lateral leg sections, of stiff metal wire which are pivotally connected at transverse sections (82*a*) joining together the lateral leg sections, while free ends of the leg sections of the first loop are pivotally connected on or in the door-related hinge member (20) and free ends of the leg sections of the second loop (82) are pivotally connected on or in the carcase-related hinge member (18).

13. The hinge according to claim 12, wherein the transverse sections (82*a*) of the U-shaped loops (82) are articulated together by a sleeve-like clip (82*d*) that reaches around the loops.

14. The hinge according to claim 11, wherein the pulling member has two spaced-apart elongated sections (82*b*) of stiff metal wire provided on opposite sides of a longitudinal central plane of the hinge, one end of each elongated section being journaled on or in the door-related hinge member (20), while the opposite end of each elongated section comprises a guide for longitudinal displacement on the carcase-related hinge member (18).

15. The hinge according to claim 14, wherein the ends of the metal wire sections (82*b*) journaled on or in the door-related hinge member (20) are additionally rotatably mountable in the hinge cup (38).

16. The hinge according to claim 14, wherein the metal wire sections (82*b*) associated with the carcase-related hinge member (18) comprise ends which are joined together by a section to form an elongated wire loop (82).

17. The hinge according to claim 16, wherein the section (82*a*) joining together the metal wire sections (82*b*) is guided for longitudinal displacement in a slot (84*a*) passing transversely through an elongated section of the carcase-related hinge member (18).

18. The hinge according to claim 17, further comprising an elongated guiding component (84) held on the carcase-related hinge member (18) wherein the slot (84*a*) is provided.

19. The hinge according to claim 18, wherein the guiding component (84) is longitudinally displaceable on the carcase-related hinge member (18).

20. The hinge according to claim 18 wherein the guiding component (84) is injection-molded from plastic.

21. The hinge according to claim 18, wherein the guiding component (84) is pressure-cast from metal.

22. The hinge according to claim 21, wherein the guiding component is an integral part of the carcase-related hinge member.

23. The hinge according to claim 1, wherein the mechanism connecting the joint-bearing component (44) with the carcase-related hinge member (18) is configured as a single-joint mechanism having an axis of rotation situated perpendicularly between the joint-bearing component and the carcase-related hinge member.

24. The hinge according to claim 1, wherein the joint mechanism connecting the joint-bearing component (45) to the carcase-related hinge member (18) is configured as a multi-joint mechanism in which the carcase-related hinge member (18) is coupled to the joint-bearing component (45) by links connected to it pivotally or displaceably.

25. The hinge according to claim 1, wherein the the joint-bearing component (44) further comprises a double bent portion (52) having hinge knuckles (54;32) for accomodating the hinge pin for connecting with the carcase-related hinge member, such that the double bent portion, when the joint-bearing component is inserted in the cup, is mountable in a rebate on the edge of the door, and the cup (38) further comprises masking sections integral with the cup which cover the marginal walls of the rebate (70) in the door (12).

26. The hinge according to claim 25, wherein the knuckles (54; 32) of the joint-bearing component (44) and of the carcase-related hinge member (48) which contain the hinge pin are mountable in a gain in the edge of the door (12) running all the way from the front to the back thereof, and wherein the cup further comprises a separate masking element (72) which conceals the edges of the gain (70) in the door (12).

27. The hinge according to claim 26, wherein the masking element (72) is stamped from sheet metal and comprises two lateral mask sections (walls 72*b*) for fittedly covering two walls defining the gain (70), joined together by a lower masking section (wall 72*a*) defining the gain (70) in the area between the bottom of the cup (38') and the outside surface of the door (12).

28. The hinge according to claim 27, further comprising strip-like maskin flanges (74*b*;74*a*) provided at the margins of the masking sections (walls 72*b*; wall72*a*), which are visible in the gain (70) when the door (12) is closed.

29. The hinge according to claim 27, further comprising a holding tongue (72*d*) cut on an edge of a lower mask section (wall 72*a*), which is bent at right angles toward the mortise (36) receiving the cup (38'), and a recess (38*a*) for snugly receiving the holding tongue (72*d*) is provided in a confronting bottom surface (38*d*) of the cup (38') facing the gain.

30. The hinge according to claim 29, further comprising detent means provided on the holding tongue (72*d*) and the confronting bottom surface of the recess (38*d*) which can be brought into engagement with one another.

* * * * *

UNITED STATES PATENT AND TRADEMARK OFFICE

CERTIFICATE OF CORRECTION

PATENT NO. : 5,632,064
DATED : May 27, 1997
INVENTOR(S) : Reinhard Lautenschlager It is certified that error appears in the above-indentified patent and that said Letters Patent is hereby corrected as shown below:

Title page, item [73], Assignee: should read--MEPLA-Werke Lautenschlager GmbH & Co. KG, Germany--.

Signed and Sealed this

Twenty-sixth Day of August, 1997

*Attest:*

Bruce Lehman

BRUCE LEHMAN

*Attesting Officer*

*Commissioner of Patents and Trademarks*